United States Patent [19]

Peebles et al.

[11] Patent Number: 4,697,944

[45] Date of Patent: Oct. 6, 1987

[54] SHEET FEEDING APPARATUS WITH COOPERATING ENDLESS BELTS

[75] Inventors: John A. Peebles; James D. Swinton, both of Dundee, Scotland

[73] Assignee: NCR Corporation, Dayton, Ohio

[21] Appl. No.: 945,050

[22] Filed: Dec. 22, 1986

[30] Foreign Application Priority Data

Nov. 6, 1986 [GB] United Kingdom ..... 8626584

[51] Int. Cl.[4] ..... B65H 5/02; B41J 13/08

[52] U.S. Cl. ..... 400/635; 198/592; 198/604; 198/628; 271/274; 271/198

[58] Field of Search ..... 271/272–274, 271/198; 400/629, 635; 198/627, 628, 626, 592, 604

[56] References Cited

U.S. PATENT DOCUMENTS

| | | | |
|---|---|---|---|
| 1,033,951 | 7/1912 | Sargent . | |
| 1,170,053 | 2/1916 | Droitcour | 271/273 |
| 2,880,998 | 4/1959 | Middleton et al. | 271/45 |
| 3,044,767 | 7/1962 | Winkler et al. | 271/2 |
| 3,132,737 | 5/1964 | Moon et al. | 271/273 X |
| 3,227,344 | 1/1966 | Rutter | 226/115 |
| 3,266,799 | 8/1966 | Ingalls | 271/198 X |
| 3,485,489 | 12/1969 | Lindquist | 271/6 |
| 4,534,550 | 8/1985 | Reist | 271/183 |
| 4,585,432 | 4/1986 | Marysse | 493/59 |

FOREIGN PATENT DOCUMENTS

| | | | |
|---|---|---|---|
| 8900 | 1/1977 | Japan | 198/627 |
| 149942 | 11/1981 | Japan | 271/272 |
| 102462 | 6/1982 | Japan | 271/272 |
| 2145399 | 3/1985 | United Kingdom . | |

*Primary Examiner*—Clifford D. Crowder

*Attorney, Agent, or Firm*—Wilbert Hawk, Jr.; Albert L. Sessler, Jr.; Elmer Wargo

[57] ABSTRACT

A sheet feeding apparatus includes a first elongated drive belt assembly (52) which is driven by, and is pivotable about the axis of, a first drive shaft (86) mounted adjacent one end of this assembly (52), and a second elongated drive belt assembly (50) which is mounted in coopertive relationship with respect to the first belt assembly (52) and which is driven by, and pivotable about the axis of, a second drive shaft (72) spaced inwardly from both ends of the second belt assembly (52). The two belt assemblies (50, 52) are pivotally movable under the control of a single solenoid between closed positions in which the belt assemblies are in cooperative relationship with respect to each other for feeding a sheet therebetween towards an exit solt (26), and open positions in which the cooperating surfaces of the belt assemblies (50, 52) are spaced apart to facilitate the entry of a sheet between the belt assemblies (50, 52) at an entry location (169).

11 Claims, 7 Drawing Figures

SHEET FEEDING APPARATUS WITH COOPERATING ENDLESS BELTS

BACKGROUND OF THE INVENTION

This invention relates to a sheet feeding apparatus. The invention has application, for example, to a self-service financial terminal or automated teller machine (ATM) including a feeding apparatus arranged to deliver a statement or receipt to an exit port for collection by a bank customer.

In U.K. Patent Application No. 2145399A, for example, there is disclosed an automated teller machine which can be used in well known manner to dispense currency notes to a user of the machine, in response to the user inserting a customer identifying card into the machine and entering certain data upon one or more keyboards associated with the machine, and which as part of a cash dispensing transaction, delivers a receipt slip to a receipt outlet slot for collection by the user. The receipt slip is produced by printing on the leading portion of a continuous form and then separating this portion from the remainder of the form, following which, the receipt slip is delivered to the receipt outlet slot by a sheet feeding apparatus. The sheet feeding apparatus includes rotating roller means which grip and apply tension to the continuous form during the printing and separating operations, and which assist in feeding the separated, receipt slip to the receipt outlet port.

Problems have been experienced with known sheet feeding apparatuses, such as that referred to above, in which the associated rotating roller means engage a sheet while the sheet is held against movement. For example, if a printing operation is carried out on a sheet while it is engaged by the rotating roller means, then lines of printing on the sheet may be distorted, or line-space errors may be introduced due to the pulling effect on the sheet.

SUMMARY OF THE INVENTION

It is, accordingly, an object of the present invention to provide a sheet feeding apparatus in which the problems referred to above are alleviated.

It is a further object of this invention to provide a sheet feeding apparatus which is of simple construction.

According to a preferred embodiment of this invention, there is provided a sheet feeding apparatus for feeding sheets one by one to an exit port, including a first elongated drive belt assembly arranged to be driven by, and pivotable about the axis of, a first drive shaft mounted adjacent one end of said first belt assembly, a second elongated drive belt assembly mounted in cooperative relationship with respect to said first belt assembly and arranged to be driven by, and pivotable about the axis of, a second drive shaft spaced inwardly from both ends of said second belt assembly, each of said belt assemblies being pivotally movable between a closed position, in which said belt assemblies are in cooperative engagement with each other for feeding a sheet therebetween towards said exit slot from an entry location of said apparatus remote from said exit slot, and an open position, in which the cooperating surfaces of said belt assemblies are spaced apart, and means for bringing about pivotal movement of said belt assemblies between their closed and open positions.

A preferred embodiment of this invention will now be described in conjunction with the following description, claims, and drawing.

DETAILED DESCRIPTION OF THE INVENTION

Figure 1:
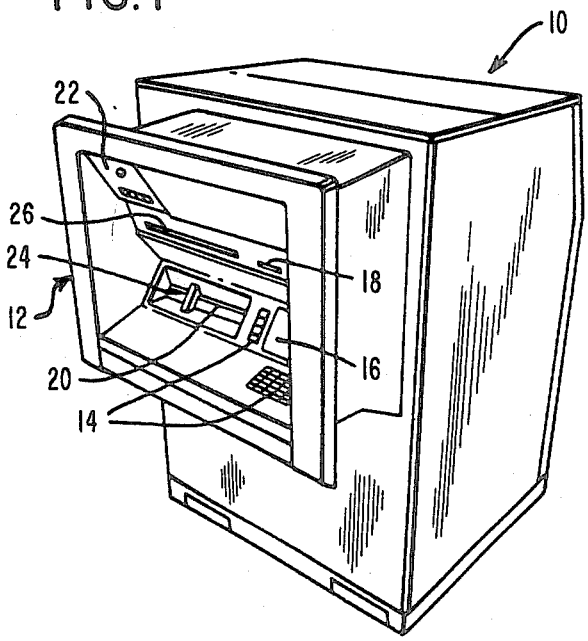
FIG. 1 is a perspective view of an automated teller machine (ATM) which includes a sheet feeding apparatus made in accordance with the present invention.

Referring to FIG. 1 of the drawing, the ATM 10 shown therein is arranged to provide various banking services as may be requested by bank customers, including the dispensing of currency notes, the acceptance of cash deposits and the provision of printed account statements. The ATM 10 includes a user console 12 in which are provided keyboards 14, a display screen 16, a card entry slot 18, a currency note exit slot 20, an envelope entry slot 24, a statement exit slot 26, and a receipt exit slot (not seen). In operation, a user inserts a customer-identifying card into the slot 18 and then enters certain data including his personal identification number upon the keyboards 14. Instructions to the user for operating the ATM 10 are displayed on the screen 16. The present invention is concerned with a sheet feeding apparatus 28 (FIGS. 3 to 6) forming part of the statement printing and presentation mechanism of the ATM 10, and accordingly the remainder of the description will be directed to this mechanism.

Figure 2:
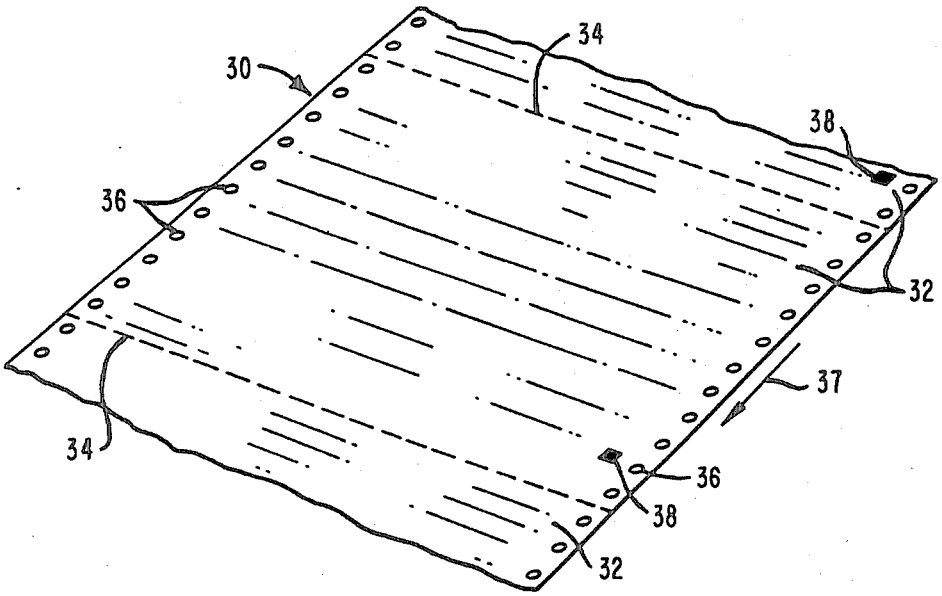
FIG. 2 is a perspective view of a portion of a continuous form used in the ATM of FIG. 1.

In response to a request for an account statement entered on the keyboards 14 by a bank customer, account information is printed on the leading portion of a continuous form 30 (FIG. 2) utilized in the ATM 10. The continuous form 30 is separable into individual sheets (corresponding to successive portions 32 of the form 30) by bursting the form along transverse weakened lines 34 such as lines of perforations. The form 30 is provided with equidistantly-spaced sprocket holes 36 adjacent to each edge, by means of which the form 30 can be moved in the direction indicated by the arrow 37. Also, each portion 32 carries a mark 38 (hereinafter referred to as a stop mark) adjacent to its leading end, the purpose of which will be described hereinafter. After the printing of account information on the leading portion or sheet 32 of the form 30 has been completed, this sheet is separated from the remainder of the form 30 by bursting the form 30 along the leading, weakened line 34, and then the separated sheet is fed to the user through the statement exit slot 26.

Figure 3:
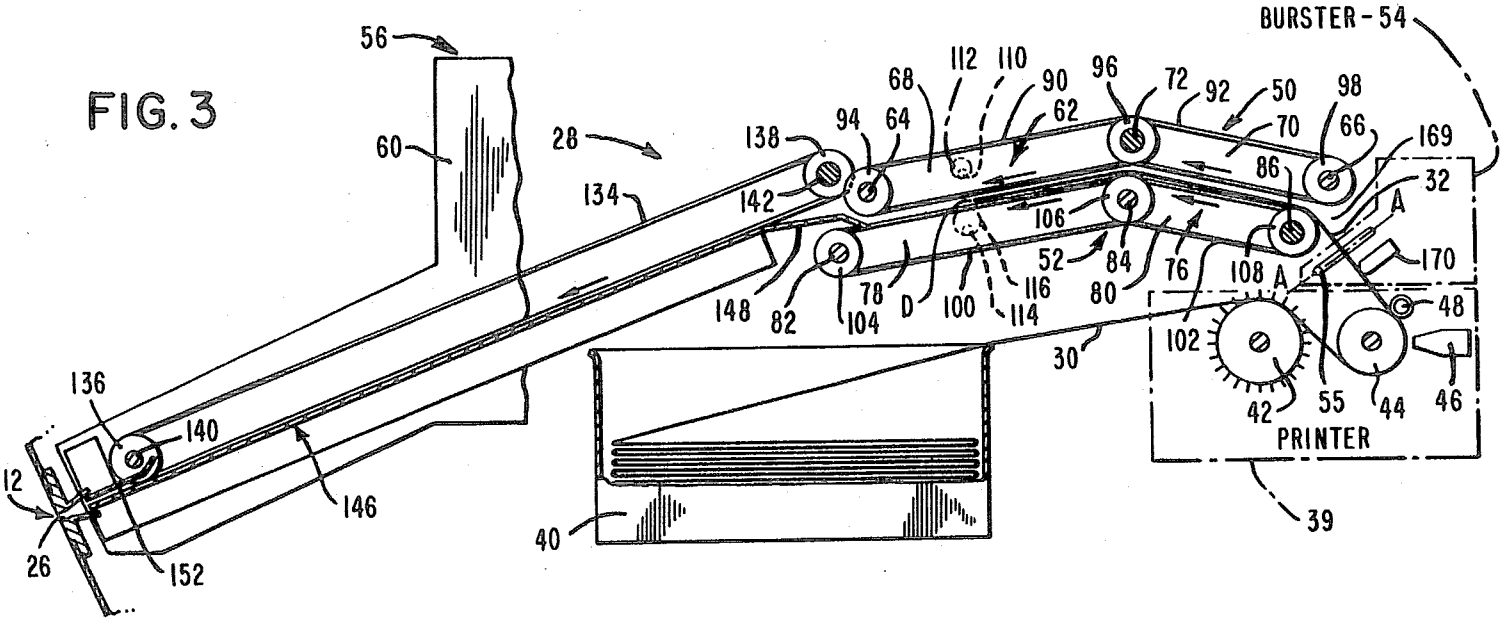
FIG. 3 is a part sectional, side elevational view of the sheet feeding apparatus, together with an associated, continuous forms supply, printing and bursting mechanisms, with the section being taken along the line III—III of FIG. 4.

Referring now to FIG. 3, the continuous form 30 is fed to a printer (schematically indicated at 39) from a storage container 40 in which the form is stored in fan-folded manner. The printer 39 includes a pair of sprocket wheels 42 which engage the sprocket holes 36 of the form 30 for the purpose of feeding the form 30 from the container 40. Downstream of the sprocket wheels 42, the form 30 passes partly around a rotatable, cylindrical platen 44 which, together with a print head 46, also forms part of the printer 39. The continuous form 30 is held against the surface of the platen 44 by a guide roller 48. In the course of a printing operation, the leading end of the form 30 is fed between upper and lower elongated belt assemblies 50 and 52, respectively, forming part of the sheet feeding apparatus 28. Between the platen 44 and the belt assemblies 50 and 52, the form 30 extends through a burster apparatus schematically indicated at 54. The burster apparatus 54 is arranged to separate the first portion or sheet 32 of the form 30 from the remainder of the form 30 by bursting the form along a burst line A—A by means of a burster rod 55, the burst line A—A passing through the leading, weakened line 34 of the form 30. As will be described in detail hereafter, the separated sheet 32' (account statement) is fed by the sheet transport apparatus 28 to the position shown in FIG. 5 where the sheet 32' partially protrudes through the exit slot 26 formed in the console 12 so as to be available for collection by the user of the ATM 10.

Figure 5:
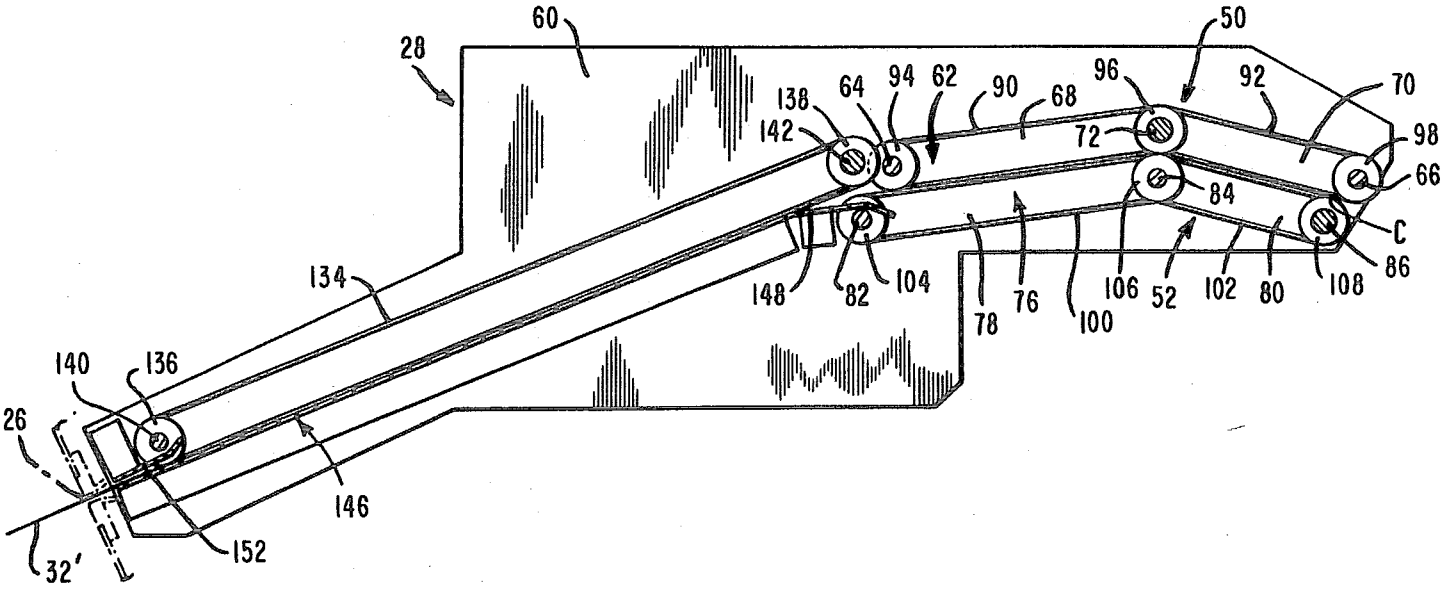
FIG. 5 is a part sectional, side elevational view of the sheet feeding apparatus similar to FIG. 3, but showing the apparatus at a different stage in a cycle of operation and omitting the associated form supply, printing, and bursting mechanisms.
Figure 6:
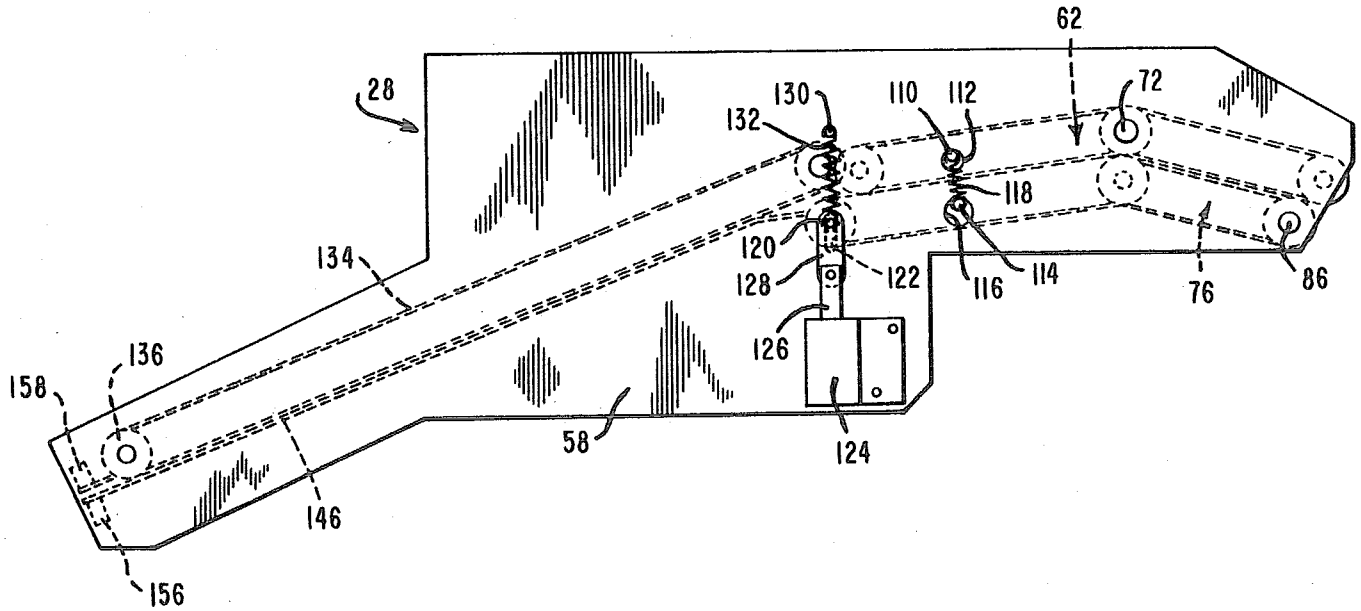
FIG. 6 is a side-elevational view of the sheet feeding apparatus taken in the direction of the arrow B in FIG. 4.
Figure 7:
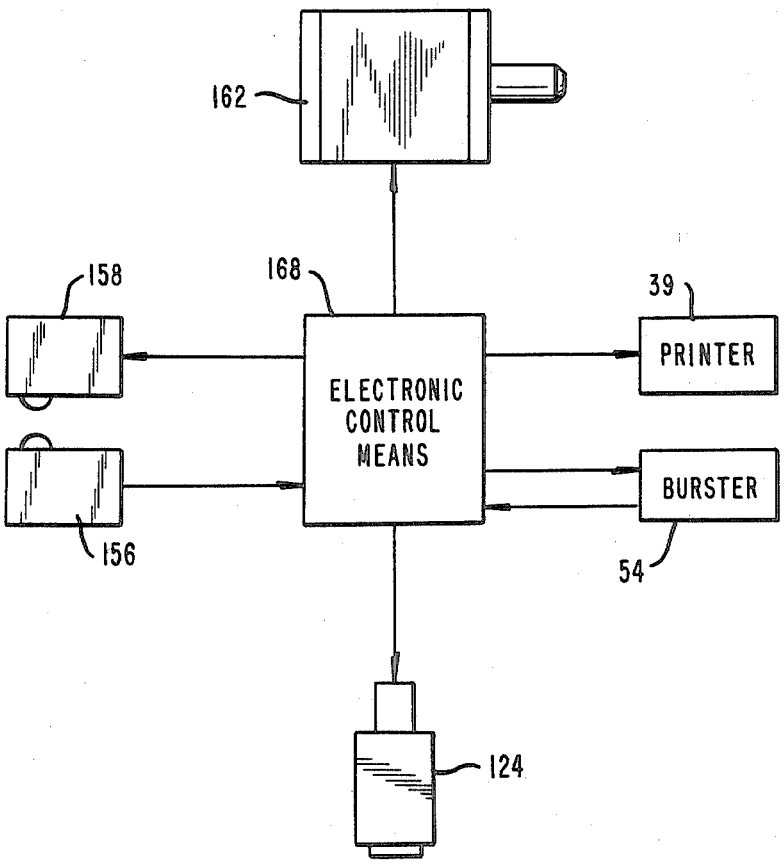
FIG. 7 is a schematic block diagram illustrating the electrical interconnections of parts of the sheet feeding apparatus and the associated printing and bursting mechanisms.

The sheet transport apparatus 28 will now be described with reference to FIGS. 3 to 7. The apparatus 28 includes a support frame 56 having parallel vertical side plates 58 and 60, between which the belt assemblies 50 and 52 are mounted. The upper belt assembly 50 includes two generally horizontally extending side support arms 62 (shown best in FIG. 4). The support arms 62 are connected together by two parallel and horizontally extending shafts 64 and 66, the shaft 64 being secured to one pair of corresponding ends of the arms 62, and the shaft 55 being secured to the other pair of corresponding ends of the arms 62. Each support arm 62 comprises two straight arm portions 68 and 70 which form a downwardly facing obtuse angle therebetween, as seen in FIGS. 3, 5, and 6. The support arms 62 are supported by, and are pivotable about the axis of, a first drive shaft 72 which passes through each arm 62 in the vicinity of the angle thereof. The drive shaft 72 extends parallel to the shafts 64 and 66 and is rotatably mounted in bearings 74 (FIG. 4) provided in the side plates 58 and 60. The lower belt assembly 52 includes two generally horizontally extending side support arms 76 which are respectively disposed beneath the support arms 62 of the upper belt assembly 50. In a similar manner to the support arms 62, each support arm 76 comprises two straight arm portions 78 and 80 which form a downwardly facing obtuse angle therebetween, again as shown in FIGS. 3, 5, and 6. The support arms 76 are connected together by two shafts 82 and 84 which extend parallel to the shafts 64, 66 and 72, the shaft 82 being secured to that pair of corresponding ends of the support arms 76 remote from the shaft 66, and the shaft 84 being secured to a portion of each support arm 76 in the vicinity of the angle thereof. The support arms 76 are supported by, and are pivotable about the axis of, a second drive shaft 86 which extends parallel to the other shafts 64, 66, 72, 82 and 84. The shaft 86 is rotatably mounted in bearings 88 (FIG. 4) provided in the side plates 58 and 60.

The upper belt assembly 50 includes a first series of four endless drive belts 90 of elastomeric material spaced apart at intervals between the side plates 58 and 60, and a series of four endless drive belts 92 of elastomeric material spaced apart at intervals between the side plates 58 and 60. Each drive belt 90 passes around a respective idler pulley 94 rotatably mounted on the shaft 64 and around a first half of an associated one of four tandem or double pulleys 96 secured on the drive shaft 72. In a similar manner, each drive belt 92 passes around a respective idler pulley 98 rotatably mounted on the shaft 66 and around a second half of an associated one of the double pulleys 96. It should be understood that the double pulleys 96 serve as drive pulleys for the belts 90 and 92.

The lower belt assembly 52 includes a first series of four endless drive belts 100 of elastomeric material which are respectively disposed beneath the belts 90 in cooperative relationship with respect thereto, and a second series of four endless drive belts 102 of elastomeric material which are respectively disposed beneath the belts 92 in cooperative relationship with respect thereto. Each drive belt 100 passes around a respective idler pulley 104 rotatably mounted on the shaft 82 and around a first half of an associated one of four double pulleys 106 rotatably mounted on the shaft 84. Each drive belt 102 passes around a respective drive pulley 108 secured on the drive shaft 86 and around a second half of an associated one of the double pulleys 106. It should be understood that the pulleys 108 serve as drive pulleys for the belts 100 and 102, the drive of the pulleys 108 being transmitted to the belts 100 via the double pulleys 106. By virtue of the angled configuration of the support arms 62 and 76, the cooperating surfaces of the belts 90 and 100 extend at an angle with respect to the cooperating surfaces of the belts 92 and 102, as seen in FIGS. 3, 5, and 6.

Two horizontally extending studs 110 (FIG. 4) are respectively secured to the outer side faces of the two support arms 62, the studs 110 respectively projecting through two circular openings 112 (FIG. 6) formed in the side plates 58 and 60. Similarly, two horizontally extending studs 114 are respectively secured to the outer side faces of the two support arms 76, the studs 114 respectively projecting through two further circular openings 116 (FIG. 6) formed in the side plates 58 and 60. As seen in FIG. 6, the openings 116 are positioned beneath the openings 112, and the diameters of the openings 112 and 116 are greater than the diameters of the studs 110 and 114, thereby permitting a certain amount of pivotal movement of the support arms 62 and 76 in a manner to be described in detail hereinafter; it is sufficient to note at this stage that the diameter of the openings 116 is greater than that of the openings 112 so as to permit the support arms 76 to undergo a greater amount of pivotal movement than the support arms 62. The projecting portions of each pair of adjacent studs 110 and 114 are connected together by a respective spring 118, the purpose of which will also be described hereinafter.

Two further studs 120 (FIG. 4) project from the ends of the shaft 82, the studs 120 being coaxial with the shaft 82 and respectively projecting through two vertically extending slots 122 (FIG. 6) formed in the side plates 58 and 60. A solenoid 124 having an upwardly extending armature 126 is secured to the outer surface of the side plate 58. The armature 126 is disposed beneath the projecting portion of the adjacent one of the studs 120, and the upper end of the armature 126 is connected to this portion of the associated stud 120 by means of a link member 128 which is pivotally joined to the armature 126 and to the associated stud 120. Two studs 130 (FIG. 4) are secured to the outer surfaces of the side plates 58 and 60 and are respectively positioned above the projecting portions of the studs 120. Each of the projecting portions of the studs 120 is connected to the associated fixed stud 130 by means of a respective spring 132. When the solenoid 124 is in a non-operated condition, the springs 132 serve to urge the lower belt assembly 52 into the position shown in FIG. 5, in which position the belts 100 and 102 of the lower belt assembly 52 are in cooperative engagement with the belts 90 and 92 of the upper belt assembly 50 over substantially the whole length of the upper belt assembly 50.

The sheet feeding apparatus 28 includes a further series of four endless belts 134 (FIG. 4) of elastomeric material which extend downwardly in an inclined manner from a position adjacent the shaft 64 to a position adjacent to the statement exit slot 26, the belts 134 being spaced apart at intervals between the side plates 58 and 60. Each of the belts 134 passes around a respective idler pulley 136 and a respective drive pulley 138. The idler pulleys 136 are rotatably mounted on a horizontal shaft 140 which extends between, and is secured to, the side plates 58 and 60, and the drive pulleys 138 are secured on a horizontal drive shaft 142 which is rotatably mounted in bearings 144 (FIG. 4) provided in the side plates 58 and 60. The belts 134 are in light cooperative engagement with the smooth upper surface of an inclined support plate 146 which extends between, and is secured to, the side plates 58 and 60. The right hand end portion 148 (with reference to FIGS. 3 and 5 of the support plate 146 is bent away from the belts 134. Six recesses 150 (FIG. 4) are formed in the end of the portion 148 in order to accommodate portions of the belts 100 and arms 76, and portions of the idler pulleys 104 (when the lower belt assembly 52 is in the position shown in FIG. 5).

As seen in FIGS. 3 and 5, the end of the portion 148 is disposed beneath the idler pulleys 94 and extends below the upper surfaces of the belts 100, the portion 148 serving to guide a separated sheet 32', fed by the belt assemblies 50 and 52, into engagement with the belts 134 for feeding by the belts 134 to the statement exit slot 26. An end guide member 152 (FIG. 5) extends between, and is secured to, the side plates 58 and 60. The guide member 152 is positioned above, and is spaced a short distance from, the left hand end (with reference to FIGS. 3 to 5) of the support plate 146, and serves to guide into the statement exit slot 26 a separated sheet 32' fed by the belts 134. Four recesses 154 (FIG. 4) are formed in the guide member 152 in order to accommodate portions of the belts 134 and of the idler pulleys 136. The passage of the leading edge of a separated sheet 32' into the exit slot 26 is sensed by an optical sensor 156 (FIG. 6) which is mounted in cooperative relationship with respect to an LED light source 158. The sensor 156 and light source 158 are aligned with recesses 160 (FIG. 4) respectively formed in the support plate 146 and the guide member 152.

Figure 4:
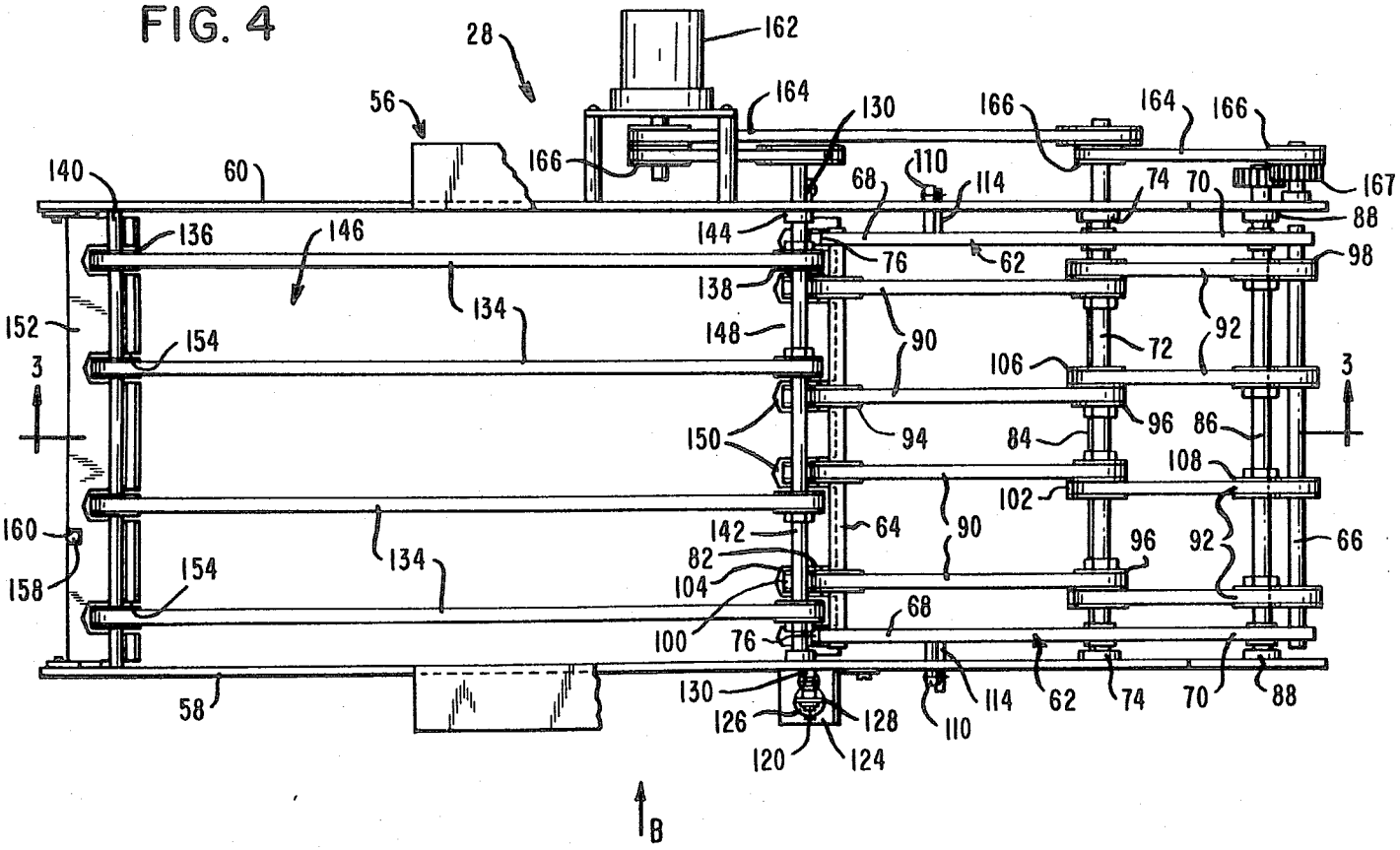
FIG. 4 is a top view of the sheet feeding apparatus shown in FIG. 3.

Referring now particularly to FIG. 4, an electric motor 162 (see also FIG. 7) is mounted on the side plate 60. The motor 162 is arranged to drive the three drive shafts 72, 86 and 142 in a simultaneous manner via drive belts 164 and pulleys 166. Energization and de-energization of the motor 162 is controlled by electronic control means 168 (FIG. 7) which is also connected to the sensor 156, the light source 158 and the solenoid 124, and which is arranged to control operation of the printer 39 and the burster apparatus 54.

The operation of the sheet feeding apparatus 28 and associated parts of the ATM 10 will now be described in connection with a transaction involving the printing of an account statement and the presentation of the statement to a user of the ATM 10. Immediately prior to the user requesting such statement, the motor 162 and the solenoid 124 are in de-energized conditions, and the sprocket wheels 42 (FIG. 3) and the platen 44 are stationary, the leading edge of the continuous form 30 being positioned at the burst line A—A. With the solenoid 124 de-energized, the belt assemblies 50 and 52 are held in the closed positions shown in FIGS. 5 and 6 by means of the springs 132. The springs 132 urge the lower belt assembly 52 to rotate in a clockwise direction (with reference to FIGS. 3, 5, and 6) about the axis of the shaft 86, and the springs 132 are of sufficient strength also to urge the upper belt assembly 50 to rotate in a clockwise direction about the axis of the shaft 72 by virtue of the engagement of the belts 100 with the belts 90. (It should be understood that in the subsequent description any mention of clockwise direction or counterclockwise direction is to be taken as being with reference to FIGS. 3, 5, and 6). Pivotal movement of the upper and lower belt assemblies 50 and 52 in a clockwise direction is limited by virtue of the belts 92 engaging the belts 102 at a position C (FIG. 5) adjacent the shaft 86, which corresponds to the closed positions of the belt assemblies 50 and 52. With the belt assemblies 50 and 52 in their closed portions, then in the absence of a sheet therebetween, the belt assemblies 50 and 52 are in engagement with each other over the whole length of the cooperating surfaces of the belts 90 and 92 and the belts 100 and 102. As seen in FIG. 6, with the belt assemblies in their closed positions, the studs 110 and 114 are positioned in the upper regions of the associated openings 112 and 116 formed in the side plates 58 and 60.

Upon the user initiating a statement printing and presentation operation by inserting his customer identifying card in the slot 18 and entering appropriate data upon the keyboards 14, the solenoid 124 is energized so as to move the belt assemblies 50 and 52 to their open positions shown in FIG. 3 (as will hereinafter be explained), and the motor 162 is energized so as to drive the drive shafts 72 and 142 in a clockwise direction and the drive shaft 86 in a counterclockwise direction, whereby the drive belts 90, 92, 100, 102 and 134 are driven in the directions of the arrows shown in FIG. 3. It will be appreciated that energization of the solenoid 124 brings about downward movement of the armature 126 and link member 128 which in turn brings about pivotal movement of the lower belt assembly 52 in a counterclockwise direction about the axis of the drive shaft 86. This pivotal movement of the lower belt assembly 52 is stopped when the studs 114 engage the lowermost parts of the edges of the openings 116, as indicated in FIG. 3. During the initial part of the counterclockwise pivotal movement of the lower belt assembly 52, the upper belt assembly 50 also rotates in a counterclockwise direction (about the axis of the shaft 72) under the action of the springs 118 (FIG. 6) connecting the studs 110 to the studs 114. It will be appreciated that, during this initial movement, the belts 102 move away from the belts 92, but parts of the belts 90 remain in contact with parts of the belts 100. The counterclockwise pivotal movement of the upper belt assembly 50 terminates prior to the counterclockwise pivotal movement of the lower belt assembly 52, by virtue of the studs 110 engaging the lowermost parts of the edges of the openings 112, which have a diameter smaller than that of the openings 116. After the counterclockwise pivotal movement of the upper belt assembly 50 has been stopped, the counterclockwise pivotal movement of the lower belt assembly 52 continues for a short period, thereby moving the belts 100 away from the belts 90, until the fully open positions of the belt assemblies 50 and 52 is reached. These fully open positions are the positions shown in FIG. 3 in which the studs 114 are in engagement with the lowermost parts of the edges of the openings 116 and in which there is a uniform gap between the belts 90 and 92 and the belts 100 and 102 over the whole length of the adjacent surfaces thereof. Thus, adjacent surfaces of the belts 90 and 100 are spaced apart and are parallel to each other, and adjacent surfaces of the belts 92 and 102 are spaced apart and are parallel to each other.

Referring now particularly to FIG. 3, the initiation of a statement printing and presentation operation also brings about operation of the sprocket wheels 42 and platen 44 so as to drive the form 30 past the print head 46 which is arranged to print account information on the leading portion or sheet 32 of the form 30. As the form 30 is fed past the print head 46, the leading portion 32 passes through the burster apparatus 54, and the leading edge of the form 30 enters the gap between the belts 92 and 102 at the entry location 169. During this movement of the form 30, the belts 92 and 102 are moving faster than the form 30, and this differential speed assists in guiding and feeding the leading part of the form 30. As the belt assemblies 50 and 52 are not in their closed positions at this time, there is avoided any excessive pull or snatch on the form 30 which might be detrimental to printer function or print quality.

After the print head 46 has completed its printing operation, the leading portion 32 of the form 30 continues to be fed through the burster apparatus 54 and between the belt assemblies 50 and 52, the above-mentioned differential speed continuing to assist in this feeding movement. This feeding movement of the form 30 continues until a sensing device 170 (FIG. 3) included in the burster apparatus 54 senses the stop mark 38 carried by the next succeeding portion 32 of the form 30. Thereupon, movement of the form 30 is stopped by stopping the sprocket wheels 42 and platen 44, the stationary sprocket wheels 42 acting as a brake on the form 30. The stop marks 38 on the form 30 are so positioned that the form 30 is stopped with the leading weakened line 34 positioned at the burst line A—A, and with the major part of the leading portion 32 of the form 30 located between the belt assemblies 50 and 52, the leading edge of this portion 32 being located at a position D (FIG. 3) between the belts 90 and 100. Also, in response to the sensing of this stop mark 38 by the sensing device 170, the motor 162 is de-energized so as to stop the belts 90, 92, 100, 102 and 134, and the solenoid 124 is de-energized so as to cause the belt assemblies 50 and 52 to be returned under the action of the springs 132 to their fully closed positions with the leading portion 32 of the form 30 gripped between the belts 90 and 92 and the belts 100 and 102. Next, the burster apparatus 54 is operated so as to burst the form 30 along the leading weakened line 34, thereby separating the leading portion 32 from the remainder of the form 30. It should be understood that immediately following the separation of the leading portion 32 from the remainder of the form 30 the separated sheet (account statement) is held in position in the sheet feeding apparatus 28 by virtue of being gripped between the belts 90 and 92 and the belts 100 and 102.

Following the bursting of the form 30 along the line A—A, the electronic control means 168 (FIG. 7) re-energizes the motor 162 so as to cause the belt assemblies 50 and 52 and the belts 134 to feed the separated sheet 32' (FIG. 5) towards the exit slot 26. It will be appreciated that, during this feeding movement, as the leading edge of the account statement 32' leaves the belt assemblies 50 and 52, this edge is guided by the end portion 148 of the support plate 146 to a position in which the leading portion of the sheet 32' is gripped between the belts 134 and the smooth upper surface of the inclined support plate 146. The belts 134 are driven at the same speed as the belts 90, 92, 100 and 102. For a time, the belts 134 assist the belt assemblies 50 and 52 in feeding the sheet 32' towards the exit slot 26, and then, the belts 134 take over completely this feeding operation. During the final part of the feeding operation, the leading edge of the sheet 32' is guided by the guide member 152 into the exit slot 26, and this leading edge is sensed by the sensor 156 in cooperation with the light source 158. Shortly after the leading edge of the sheet 32' is sensed by the sensor 156, the electronic control means 168 causes the motor 162 to be de-energized so as to stop the belts 134 with the sheet 32' held between the belts 134 and the support plate 146 in the position shown in FIG. 5. As previously mentioned, with the sheet 32' in this position, it is available for collection by the user of the ATM 10. Following removal by the user of the sheet 32' form the exit slot 26, the ATM 10 is available for the carrying out of a further statement printing and presentation operation, or of some other transaction as may be requested by a user.

The sheet feeding apparatus 28 described above has the advantage that, subsequent to a bursting operation, the belt assemblies 50 and 52 in their closed positions provide a good, driving grip for feeding a separated sheet towards the exit slot 26, and that, during a printing operation, the belt assemblies 50 and 52 in their open positions apply a small amount of frictional drag to the leading portion of the continuous form 30, thereby assisting in guiding and feeding this portion between the belt assemblies 50 and 52 but without exerting any excessive pull or drag on the form 30. It has been found that the good driving grip provided by the belt assemblies 50 and 52 in their closed position can be achieved over a wide range of sheet lengths and widths; for example, a good grip is achieved for sheets ranging in length from about 10 to 30 centimeters and ranging in width from about 16 to 24 centimeters. The arrangement described above has significant advantages over a prior art sheet feeding apparatus, such as has been referred to earlier herein, in which the rotating roller means grip and apply tension to a continuous form during printing and separating operations. Thus, a particular problem with such a prior art arrangement is that of achieving a sufficiently low pinch pressure to allow slipping movement of the roller means while a sheet is undergoing a printing operation, but a sufficiently high pinch pressure to provide a good driving grip when feeding movement of the sheet is to take place; in consequence, deficiencies in both modes of operation may result. This problem is particularly difficult to overcome in a prior art apparatus of this type if the apparatus is intended to handle sheets having different dimensions. The sheet feeding apparatus 28 described above overcomes this problem in a very effective manner.

Another important advantage of the sheet feeding apparatus 28 is that the mechanism for opening and closing the belt assemblies 50 and 52 is very simple, the opening and closing operations being achieved using only one solenoid. Moreover, compared with a feeding mechanism employing four or more sets of pinch rollers (which are as much as 30 centimeters in length), the belt system comprising the belt assemblies 50 and 52 requires fewer shafts and also does not require any guides, resulting in a significant cost reduction.

A further advantage of the sheet feeding apparatus 28 is that the angled form of construction of the belt assemblies 50 and 52 results in a compact configuration for the apparatus 28.

What is claimed is:

1. A sheet feeding apparatus for feeding sheets one by one from an entry location therein to an exit slot therein, comprising:

a first drive shaft;

a first elongated drive belt assembly arranged to be driven by, and pivotable about the axis of, said first drive shaft which is mounted adjacent one end of said first elongated drive belt assembly;

a second drive shaft;

a second elongated drive belt assembly mounted in cooperative relationship with respect to said first elongated drive belt assembly and arranged to be driven by, and pivotable about the axis of said second drive shaft which is spaced inwardly from both ends of said second elongated drive belt assembly;

each of said first and second elongated drive belt assemblies being pivotally movable between a closed position in which said first and second elongated drive belt assemblies are in cooperative engagement with each other for feeding a sheet therebetween towards said exit slot from said entry location and an open position in which the cooperating surfaces of said first and second elongated drive belt assemblies are spaced apart; and means for bringing about pivotal movement of said first and second elongated drive belt assemblies between their said closed and open positions.

2. The sheet feeding apparatus as claimed in claim 1, wherein said means for bringing about pivotal movement of said first and second elongated drive belt assemblies includes:

actuating means operable to bring about pivotal movement of said first elongated drive belt assembly from its closed position to its open position;

first spring means arranged to bring about pivotal movement of said second elongated drive belt assembly from its closed position to its open position when said first elongated drive belt assembly is moved from its closed position to its open position by said actuating means; and second spring means arranged to bring about pivotal movement of said first and second elongated drive belt assemblies from their open positions to their closed positions when said actuating means changes from an operated to a nonoperated condition.

3. The sheet feeding apparatus as claimed in claim 2, wherein said first spring means are connected between said first and second elongated drive belt assemblies, said first spring means being connected to said second elongated drive belt assembly on that side of said second drive shaft remote from said one end of said first elongated drive belt assembly.

4. The sheet feeding apparatus as claimed in claim 3, including first and second stop means respectively arranged to limit the pivotal movement of said first and second elongated drive belt assemblies away from their closed positions brought about in response to operation of said actuating means; the pivotal movement of said second elongated drive belt assembly away from its closed position being terminated by said second stop means prior to the pivotal movement of said first elongated drive belt assembly away from its closed position being terminated by said first stop means.

5. The sheet feeding apparatus as claimed in claim 4 wherein said actuating means is a solenoid.

6. The sheet feeding apparatus as claimed in claim 5 wherein said first elongated drive belt assembly includes first and second belt means, and wherein said second elongated drive belt assembly includes third and fourth belt means which are respectively disposed in cooperative relationship with respect to said first and second belt means, the cooperating surfaces of said first and third belt means extending at an angle with respect to the cooperating surfaces of said second and fourth belt means.

7. The sheet feeding apparatus as claimed in claim 6 including a support plate, an electric motor, and a further belt assembly which is mounted in cooperative relationship with respect to said sheet support plate between said first and second elongated drive belt assemblies and said exit slot, said further belt assembly being arranged to be driven by said electric motor simultaneously with said first and second elongated drive belt assemblies, and being arranged to engage a sheet fed by said first and second elongated drive belt assemblies from said entry location and to feed such sheet over said support plate to said exit slot.

8. The sheet feeding apparatus as claimed in claim 7 including a control means for controlling said electric motor arranged to drive said first and second drive shafts, whereby, in operation, said first and second elongated drive belt assemblies are driven when in their open positions and during a feeding movement of a sheet when in their closed positions, but are stationary during a period immediately following movement of said first and second elongated drive belt assemblies from their open positions to their closed positions.

9. The sheet feeding apparatus as claimed in claim 8 including sensor means positioned adjacent to said exit slot and arranged to sense the passage of a leading edge of a sheet during the feeding movement of the sheet to said exit slot, said control means being arranged to stop said electric motor in response to the sensing of said leading edge by said sensor means.

10. The sheet feeding apparatus as claimed in claim 8, including a printing means arranged to carry out a printing operation on the leading portion of a continuous form and to feed the leading edge of said leading portion between said first and second elongated drive belt assemblies in their open positions at said entry location, and also including a separating means arranged to separate said leading portion from the remainder of said continuous form when said first and second elongated drive belt assemblies are stationary and in their closed positions.

11. The sheet feeding apparatus as claimed in claim 10 wherein said first and second elongated drive belt assemblies are driven at a speed greater than the speed at which said leading portion of said continuous form is fed by said printing means between said first and second elongated drive belt assemblies.

* * * * *